US006077162A

United States Patent [19]

Weiss

[11] Patent Number: 6,077,162

[45] Date of Patent: Jun. 20, 2000

[54] COOPERATIVE GROUP GAMING SYSTEM: APPARATUS AND METHOD

[75] Inventor: Steven A. Weiss, Las Vegas, Nev.

[73] Assignee: Casino Data Systems, Sacramento, Calif.

[21] Appl. No.: 08/787,401

[22] Filed: Jan. 22, 1997

[51] Int. Cl.[7] ..... A63F 9/22

[52] U.S. Cl. ..... 463/26; 463/25; 463/20; 463/12; 463/13; 273/143 R; 273/274

[58] Field of Search ..... 463/27, 28, 26, 463/25, 16, 17, 18, 19, 20, 12, 13, 40, 41, 42, 46; 273/274, 292, 121 B, 138.2, 143 R

[56] References Cited

U.S. PATENT DOCUMENTS

| | | | |
|---|---|---|---|
| 5,078,405 | 1/1992 | Jones | 463/27 |
| 5,116,055 | 5/1992 | Tracy | 463/27 |
| 5,275,400 | 1/1994 | Weingardt | 463/27 |
| 5,393,057 | 2/1995 | Marnell, II | 463/27 X |
| 5,472,194 | 12/1995 | Breeding et al. | 463/27 |
| 5,564,700 | 10/1996 | Celona | 463/27 |
| 5,645,486 | 7/1997 | Nagao et al. | 463/27 |
| 5,688,174 | 11/1997 | Kennedy | 463/46 X |
| 5,743,798 | 4/1998 | Adams et al. | 463/27 |
| 5,766,076 | 6/1998 | Pease et al. | 463/27 |

*Primary Examiner*—Michael O'Neill
*Attorney, Agent, or Firm*—Bernhard Kreten

[57] ABSTRACT

A cooperative group gaming apparatus and method therefore including a plurality of gaming machines including means for individual play, means for communal play and communal payout means influenced by any gaming machine participating in cooperative group play, said plurality of gaming machines operatively coupled to at least one controller which, inter alia, communicates with at least one display means for displaying the effects of cooperative group play to game players.

25 Claims, 7 Drawing Sheets

COOPERATIVE GROUP GAMING SYSTEM: APPARATUS AND METHOD

FIELD OF THE INVENTION

The present invention relates generally to gaming systems and, in particular, to a cooperative group gaming apparatus and method therefore which allows a plurality of players to contribute, participate and share in a group reward when at least one participating player obtains a recognized winning combination on a gaming instrumentality.

BACKGROUND OF THE INVENTION

Gaming machines, particularly slot machines have become one of the more exciting wagering adventures available at casinos and the like. However, playing these slot machines is typically an insular and isolated activity. Even with the advent of "progressive" type machines the gaming experience remains a solitary one with a progressive jackpot escalating as a function of many players' activities yet being won by only the first person to achieve a certain outcome in a "winner take all" scheme. Thus, gaming machines continue to promote an "antisocial" and competitive environment.

However, there is a dichotomy among all players: one group appears to prefer the solitary pursuit of today's "winner take all" slot and video machines while a second group gambles for the entertainment experience and not the economic potential as a principal motivation.

Therefore, a need exists for a gaming apparatus and method therefore which encourages a communal spirit and encourages camaraderie among players during the course of play to provide not only a gaming experience with a far greater entertainment value, but also an opportunity for one player to contribute to the well being of all participants collectively and for one player individually.

Thus, a need exists for a game where a group of players contribute to a jackpot which is shared by all when at least one player succeeds in "hitting" a recognized winning combination thereby allowing the entire group of players to share in the excitement and reward of being a winner.

SUMMARY OF THE INVENTION

The present invention is distinguished over known gaming systems in a multiplicity of ways. For one thing, the present invention provides a cooperative group gaming apparatus and method therefore which provides a gaming experience which encourages camaraderie and communal spirit by allowing a plurality of players to contribute, participate and share in an award when at least one player in a community of players achieves a winning outcome.

In addition, the present invention encourages social interaction among a plurality of players thereby providing the players with a cooperative group gaming experience which provides players with the joy and fun associated with team play. Therefore, the present invention provides a cooperative group gaming apparatus and method therefore which provides an alternative to the solitary pursuit of a "winner take all" jackpot or a lifestyle-changing jackpot.

For example, one such scenario could involve a plurality of conventional gaming machines all operatively coupled to at least one controller and one or more communal displays. Each machine includes means for individual play and is adapted to permit a player on each machine to participate in cooperative group play by contributing a wager to a communal jackpot. The communal wagers are communicated from the gaming machines to the controller which controls the communal jackpot value displayed on at least one communal display. When at least one player in the community achieves a recognized winning outcome, all participating players win a portion of the communal jackpot thereby promoting a cooperative gaming experience which provides camaraderie among players both when wagering and winning.

OBJECTS OF THE INVENTION

Accordingly, it is an object of the present invention to provide a new and novel cooperative group gaming apparatus and method therefore.

A further object of the present invention is to provide an apparatus and method as characterized above which is extremely enjoyable and increases players gratification by allowing interaction among various players having a common goal and sharing in the rewards associated with anyone obtaining the common goal.

Another further object of the present invention is to provide an apparatus and method as characterized above which promotes a communal wagering and winning environment.

Another further object of the present invention is to provide an apparatus and method as characterized above which encourages camaraderie and communal spirit among players.

Another further object of the present invention is to provide an apparatus and method as characterized above which incorporates team spirit into a gaming experience.

Another further object of the present invention is to provide an apparatus and method as characterized above which is durable in construction, automated for efficiency and reliable to use.

Another further object of the present invention is to provide an apparatus and method as characterized above which also may include a component sometimes defined as luck.

Viewed from a first vantage point, it is an object of the present invention to provide a cooperative group gaming apparatus, comprising in combination: a bank of gaming machines, each gaming machine having means for individual play, and each gaming machine having means for communal play; a meter reflecting communal activity; and communal payout means influenced by any machine participating in communal play.

Viewed from a second vantage point, it is an object of the present invention to provide a method for sharing from communal gaming activity, the steps including: uniting a plurality of machines to enable both independent play and communal play; displaying the effect of communal play, and distributing a series of awards to communal players when at least one player in the community of players achieves a recognized winning outcome.

Viewed from a third vantage point, it is an object of the present invention to provide a method for providing a cooperative group gaming system, the steps including: providing a bank of gaming machines, each gaming machine having means for individual play and communal play; providing at least one display means operatively coupled to the bank of gaming machines for displaying communal gaming activity; distributing a plurality of awards to communal players when at least one player in the community achieves a recognized winning outcome.

These and other objects will be made manifest when considering the following detailed specification when taken in conjunction with the appended drawing figures.

DESCRIPTION OF PREFERRED EMBODIMENTS

Figure 1:
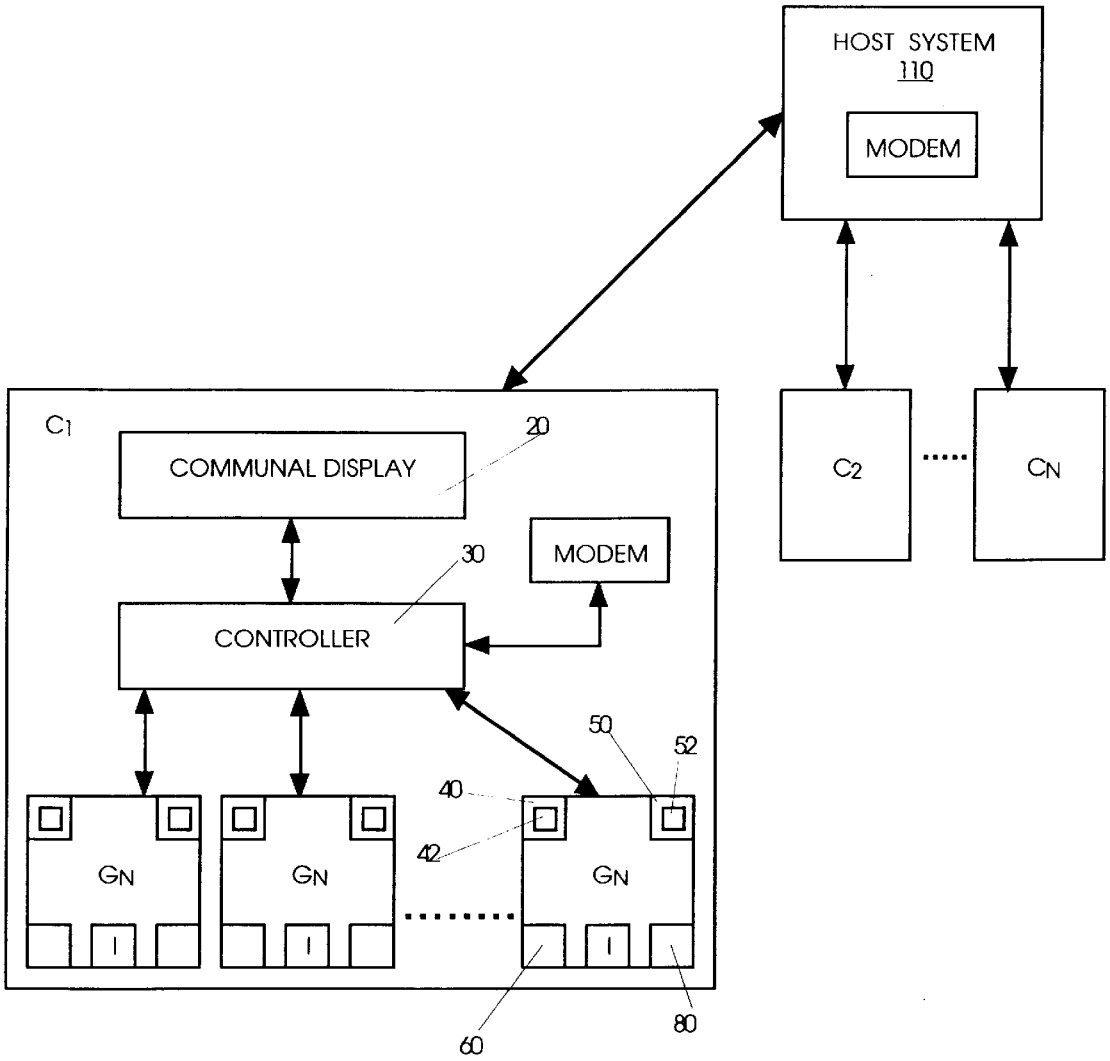
FIG. 1 is a schematic depiction of an apparatus according to one form of the present invention.

Considering the drawings, wherein like reference numerals denote like parts throughout the various drawing figures, reference numeral 10 is directed to a cooperative group gaming system according to the present invention.

In its essence, and referring to FIG. 1, the cooperative group gaming system 10 includes a plurality of gaming means such as machines $G_1$, $G_2$ . . . $G_N$. Each gaming machine is operatively coupled to at least one communal display 20 and includes individual play means 40 and communal play means 50. The individual and communal play means 40, 50 allows a group of players to play individual machines while simultaneously participating in cooperative group play by contributing a wager to a communal jackpot. The communal jackpot is displayed on the communal display 20 such that when at least one player "hits" a recognized winning outcome, a series of awards is distributed to communal players via communal payout means 60. In addition, a plurality of gaming machines at various remote gaming sites $C_1$, $C_2$ . . . $C_N$ may be operatively coupled to a host computer system 110 for multi-site cooperative group gaming.

More specifically, the cooperative group gaming system 10 includes a plurality of gaming machines $G_1$, $G_2$ . . . $G_N$ which may even embody a conventional or familiar wagering game, such as a video poker game or a spinning three reel type wagering device known in the art. The machines may be configured into a plurality of clusters or banks which operate under at least one controller 30 which drives one or more displays 20 for displaying a communal jackpot.

Typically, these machines $G_N$ are driven by a "computer" 80 including a power supply means, a processor/controller, a random number generator means and a memory means having integral or programmable representation of a pay table, game criteria and game graphics.

In addition, each gaming machine includes individual play means 40 and communal play means 50 which respectively include input means 42, 52 which allow the player to, inter alia, select play options to easily manipulate a game. The input means 42, 52 may include push buttons, a key board, a mouse or a light pen. Gaming machines having a video display may employ input means in the form of a touch screen in which play options may be selected by simply touching an image on the screen. Thus, a wager may be placed to initiate game play and the input means 42, 52 may be manipulated to effect individual play and communal play.

For example, once a wager has been placed, push buttons may be used to direct the wager for individual play, communal play or both and also to control the "progression" of the game. The player may communicate the type of wager by actuating an individual bet button, a communal bet button or a combination bet button. The pay table associated with each gaming machine announces to each player the circumstances surrounding the winning of prizes, the denominations of which vary with respect to the nature of the win. Payout of the individual and communal jackpots may be through the communal payout means 60 including a typical coin dispenser feeding coins through a chute and into a tray of each respective gaming machine. Alternatively, payouts may be credited to the appropriate accounts of players using player cards.

Figure 2:
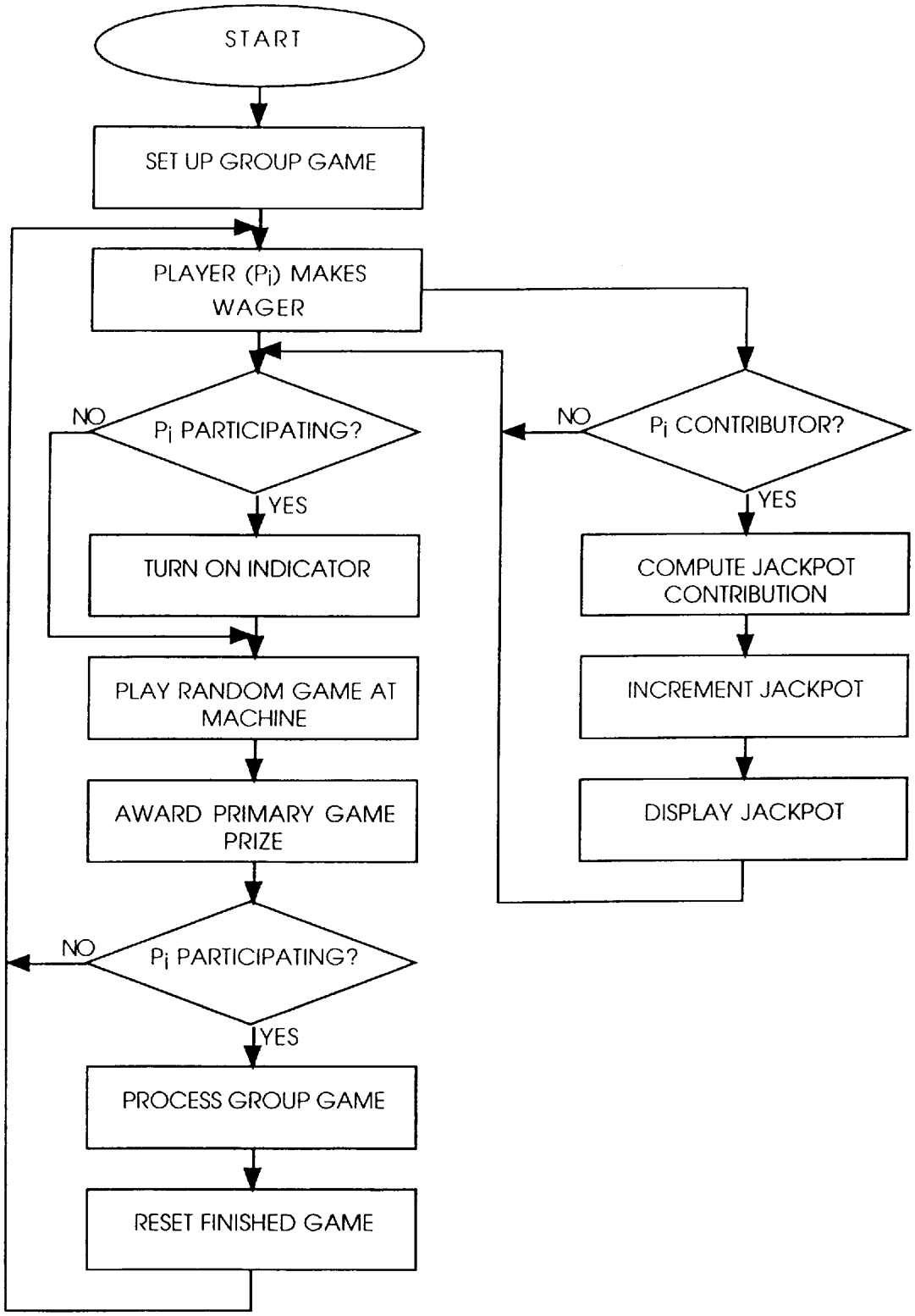
FIG. 2 is a main flowchart of a method according to one form of the present invention.

Considering FIG. 2, thereshown is a main flowchart of one preferred form of the cooperative group gaming system 10 according to the present invention. On start up, the system 10 performs a set up mode.

Figure 3:
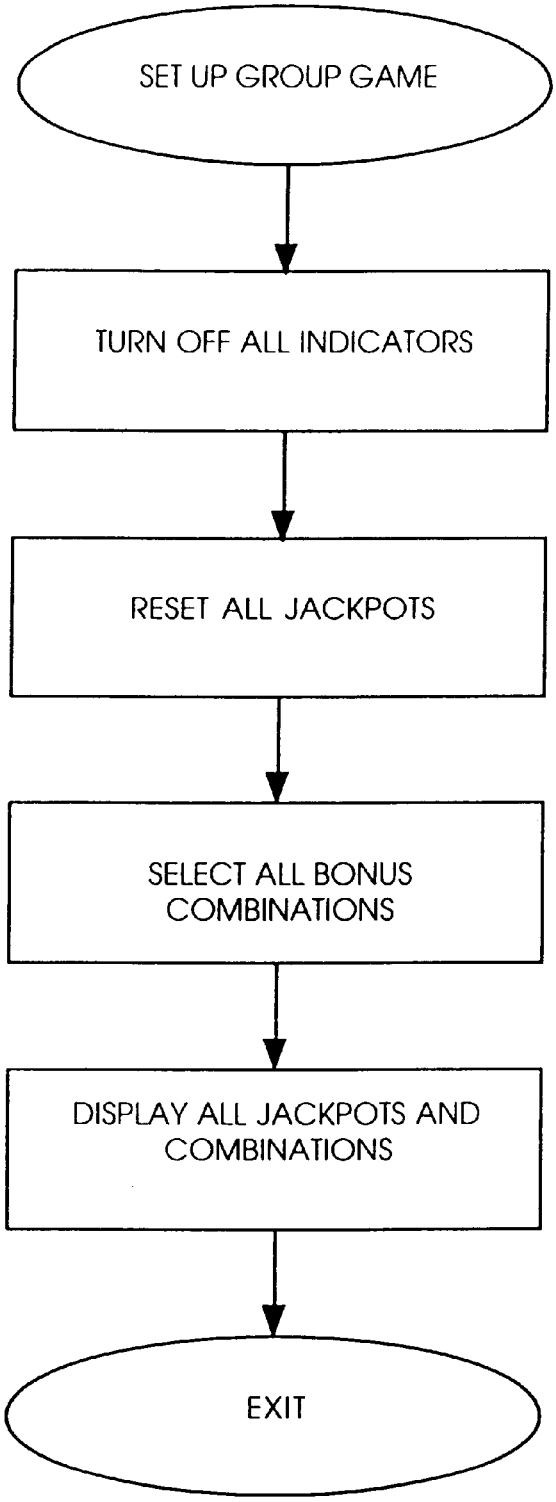
FIG. 3 is a flowchart of a set-up group game method according to one form of the present invention.

Referring to FIG. 3, the first step of the set up mode is to initialize the system and it is best to turn off all indicators I identifying the plurality of gaming machines G, then reset all jackpots, select bonus combinations and display all jackpots and combinations. Preferably, the system predetermines at least one combination which constitutes a bonus event. For example, five randomly selected cards (or three symbols) may be designated as the bonus event. Each player $P_i$ on gaming machine $G_i$ ($G_i$ being any machine $G_1$ through $G_N$) then makes a wager which may include a contribution to a communal jackpot (JP) which is then incremented and displayed on the communal display 20. The processor/controller then determines if each player $P_i$ is participating in the communal jackpot and if so, turns on an indicator I. If any player $P_i$ is not participating in the communal jackpot, that gaming machine $G_i$ is played according to that game's criteria and its winnings are awarded based on that individual game's associated pay table.

In the event that player $P_i$ is participating in the communal jackpot, the system performs a process group gaming operation.

Figure 4:
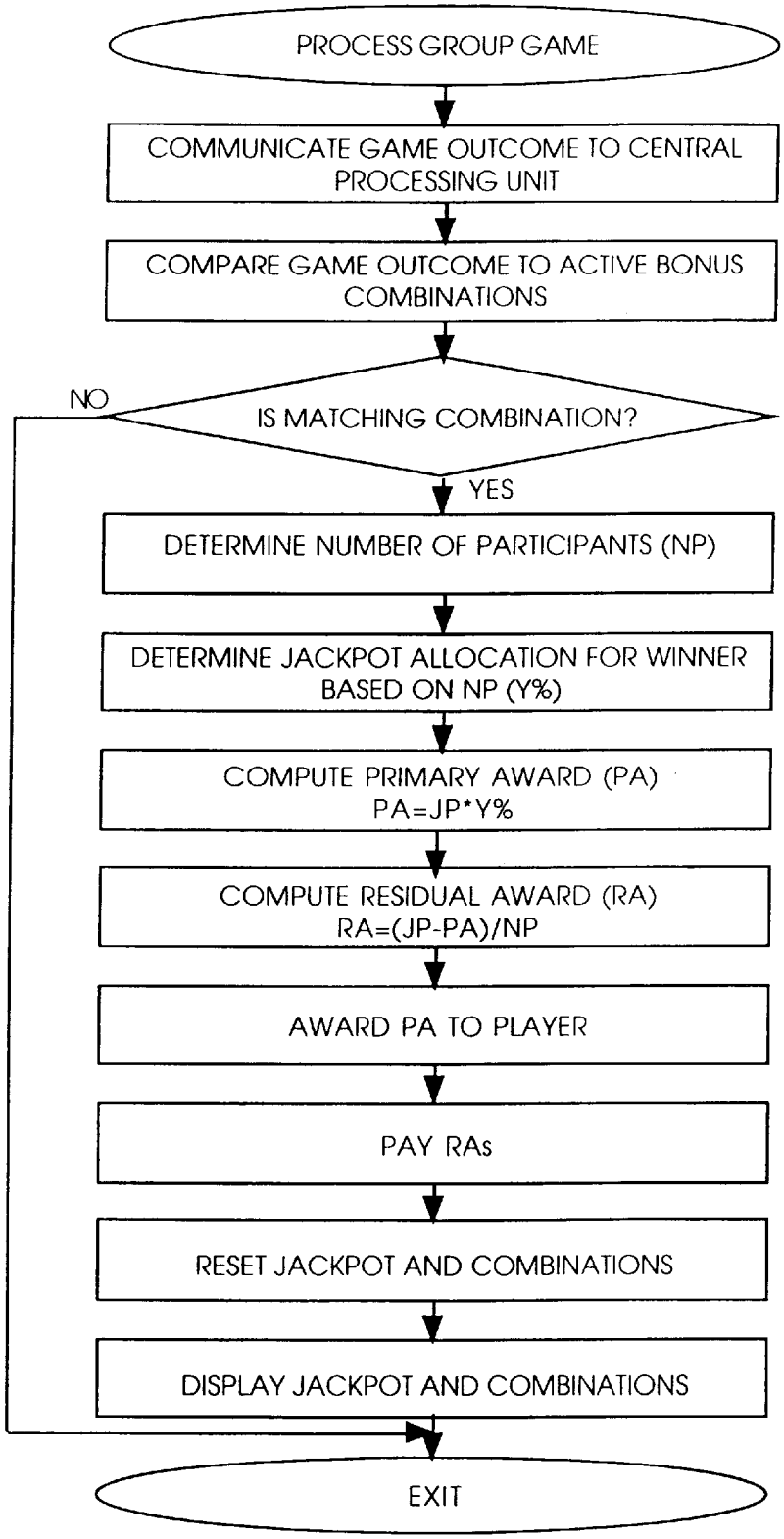
FIG. 4 is a flowchart of a process group game method according to one form of the present invention.

Referring to FIG. 4, the process group gaming operation includes the steps of determining if the player $P_i$ has a winning outcome according to a pay table and/or any active bonus combinations. If player $P_i$ has obtained a winning outcome, the number of participants (NP) is determined. Once the number of participants (NP) has been determined, the next step is to determine a communal jackpot allocation percent (Y%) for the winner based on the number of players (NP) and then compute a primary award (PA) which is Y% of the total amount contributed to the communal jackpot (JP) by all participating players thus, PA=JP * Y%. Residual awards are then determined according to the formula: RA=(JP−PA)/NP. The primary award is then awarded to the winner, player $P_i$, and the residual award is awarded to all players participating in the communal jackpot.

Figure 5:
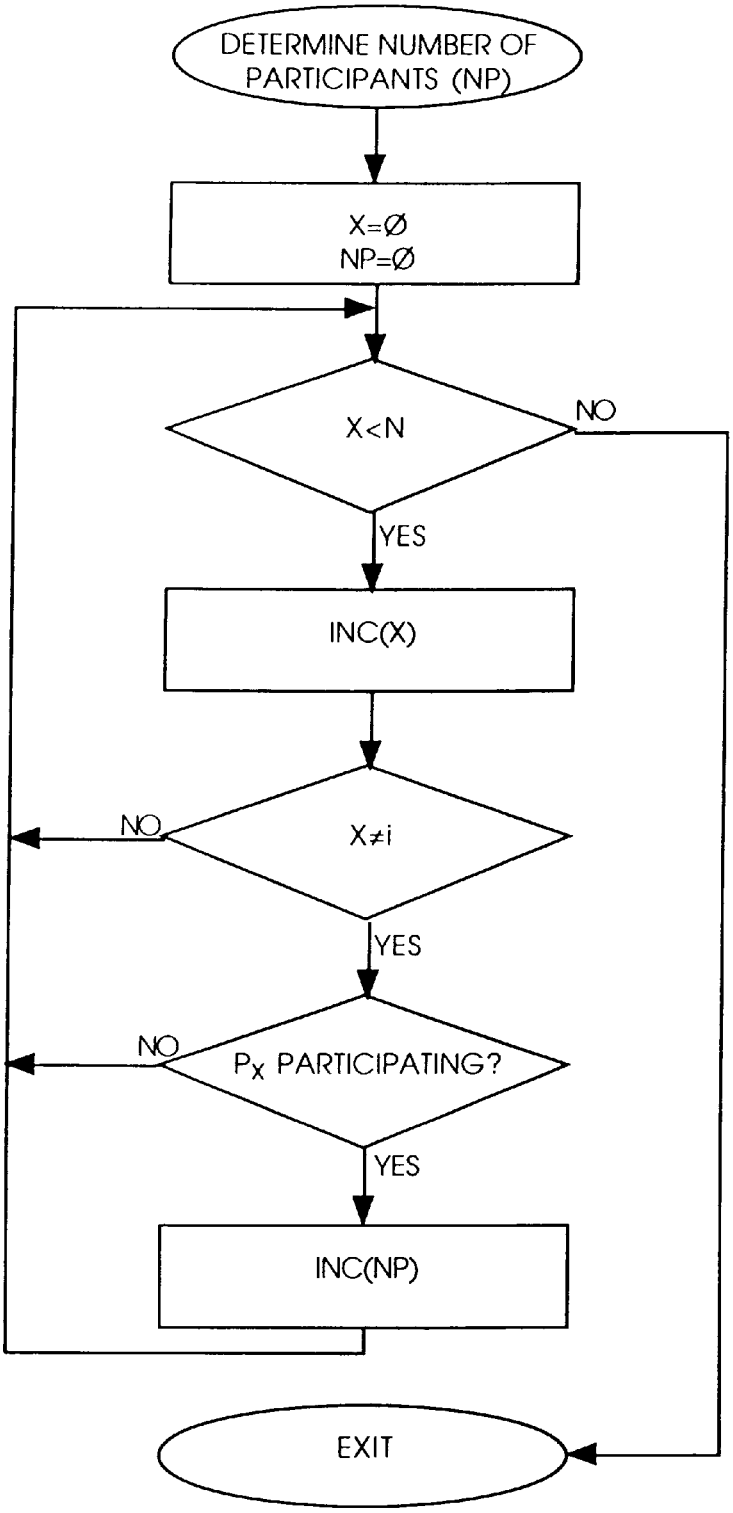
FIG. 5 is a flowchart of a determine a number of participants method according to one form of the invention.

FIG. 5 shows one method of how the number of participants may be determined. A counter means may be used with an initial number of players set to zero (NP=Ø) and a machine counting constant X set to zero (X=Ø). As long as the counting constant X is less than N (the total number of machines) X will be incremented (i.e., X=X+1). Next, an operation is performed to determine if the player on the Nth machine is participating in the communal jackpot and if so the NP counter means is incremented. This loop continues until all "N" machines have been polled. Note that the loop can contain an operation which skips the player who has hit a winning combination on a gaming machine. This is in the form of a decision operation represented by the question does "X" not equal i or the machine $G_i$ in which player $P_i$ has obtained a winning combination. In addition, if a player $P_x$ is not participating, the number of players (NP) is not incremented and the next operation is the start of the loop. When "X" is not less than N, the loop is exited.

Figure 6:
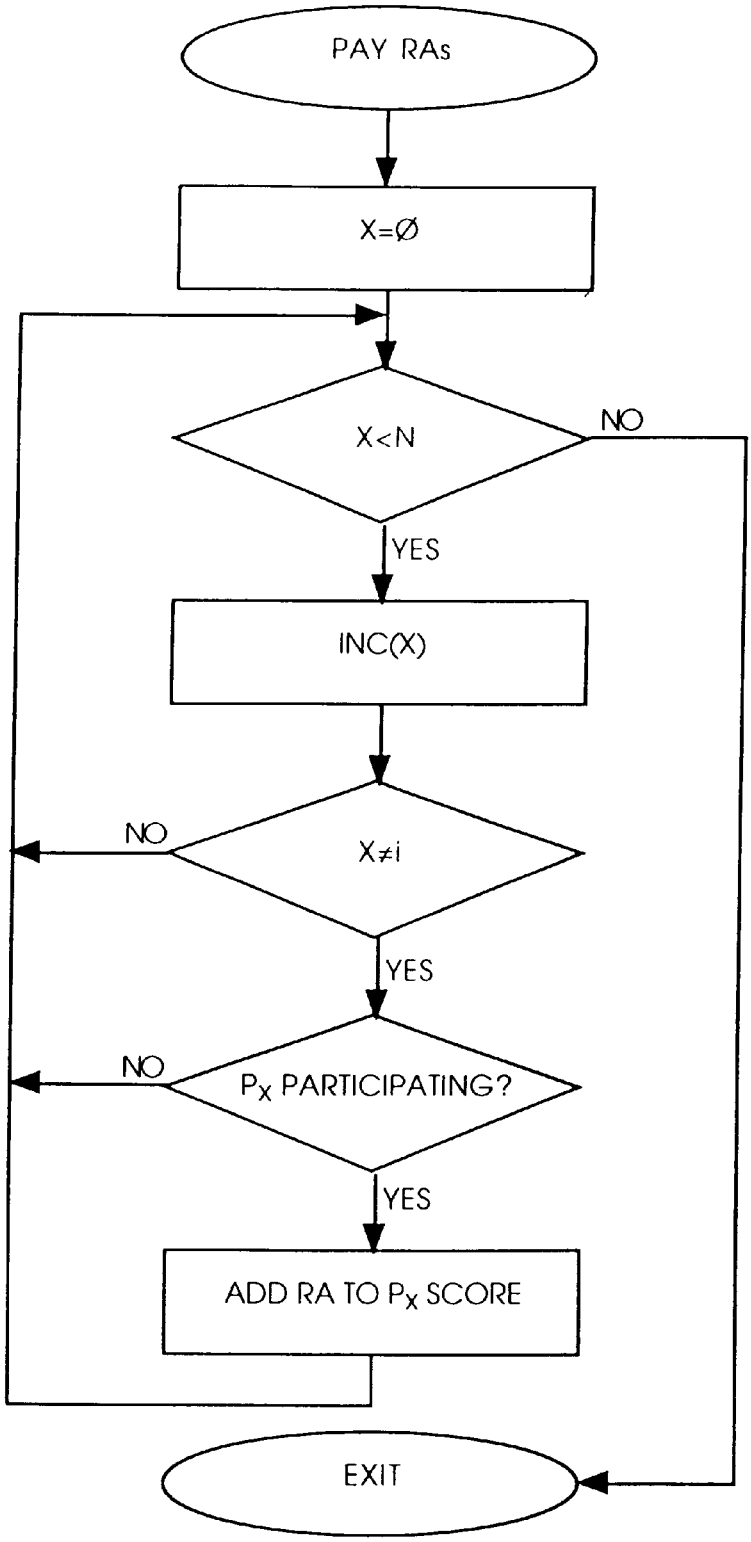
FIG. 6 is a flowchart of a pay residual award method according to one form of the present invention.

FIG. 6 shows one method of how the residual awards are awarded to participating players. A counter means may be used with a machine counting constant X set to zero (X=Ø). As long as the counting constant X is less than N (the total number of machines), X will be incremented (i.e., $X=X_{+1}$). Next, an operation is performed to determine if the player on the Nth machine is participating in the communal jackpot and if so the residual award is paid out or added to the players total credit score. This loop continues until all "N" machines have been polled. Note that the loop can contain an operation which skips the player who has obtained a winning combination on a gaming machine. This is in the form of a decision represented by the question does "X" not equal i or the machine $G_i$ in which player $P_x$ has obtained a winning combination. Note that this decision operates in the same fashion as the similar decision found in FIG. 5.

Figure 7:
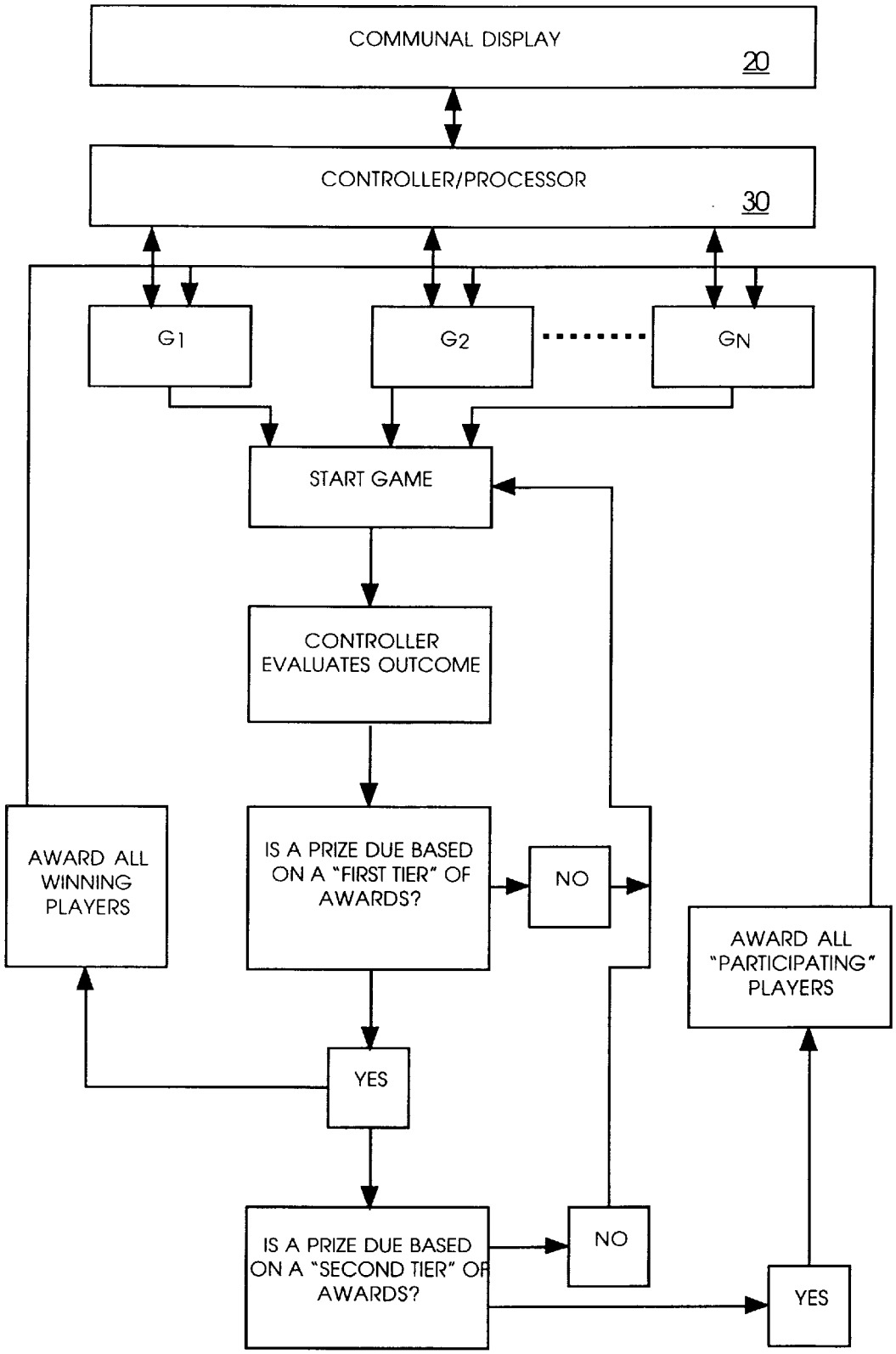
FIG. 7 is a main flowchart of an alternative method according to the present invention.

FIG. 7 shows a main flowchart of an alternative form of the cooperative gaming system 10 according to the present invention. A plurality of gaming machines $G_1$, $G_2$ . . . $G_N$ are shown operatively coupled to a communal display 20 via a controller 30. Game play on each machine is initiated with a wager which may include a contribution to a communal jackpot which is displayed on the communal display 20. The outcome of each game is then evaluated to determine if a prize is due based on a "first tier" of awards and if so the prize is awarded to each player on each machine having a winning outcome.

In addition, when at least one player in the community of players achieves a recognized winning outcome, all participating players receive an award based on a "second tier" of awards.

If a prize is not due based on the "first tier" of awards, each respective machine awaits a next wager for subsequent play. Likewise, each machine awaits a next wager for subsequent play when a prize is due based on the "first tier" but is not due based on the "second tier".

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A cooperative group gaming system, comprising, in combination:

a bank of individual gaming machines, each said individual gaming machine having means for individual play including means for receiving a wager, and each said individual gaming machine including an indicator means;

said indicator means transitioning from an off state to an on state on each said individual gaming machine having received a communal contribution by a player to reflect player participation;

each said individual gaming machine having means for communal play, and a meter reflecting communal activity; and communal payout means influenced by any machine participating in communal play;

wherein said communal payout means distributes an award of the communal jackpot to at least one player achieving a winning outcome recognized by the system and distributes another award to all remaining players participating in communal play.

2. The system of claim 1 wherein said meter reflects communal activity in the form of a communal jackpot amount.

3. The system of claim 2 wherein said communal payout means distributes a primary percentage of the communal jackpot to at least one player achieving a winning outcome recognized by the system and distributes the remainder to all remaining players participating in communal play.

4. The system of claim 2 wherein said communal payout means equally distributes the communal jackpot to all participating players when at least one player achieves a winning outcome recognized by the system.

5. The system of claim 2 further including means for distributing a first award based on a first tier of awards to all players achieving a winning outcome recognized by the system.

6. The system of claim 5 wherein said communal payout means equally distributes a second said award based on a second tier of awards to all participating communal players.

7. The system of claim 6 wherein said first tier of said awards is based on a paytable associated with said gaming machine in which a winning outcome has been achieved.

8. The system of claim 7 wherein said second tier of said awards is based on the communal jackpot.

9. The system of claim 5 wherein said communal payout means distributes a second said award based on a second tier of awards to all participating communal players except for players winning said first award.

10. A method for sharing from communal gaming activity, the steps including:

uniting a plurality of machines to enable both independent play and communal play;

providing an indicator means on each of the plurality of gaming machines, each of the indicator means including an on state and an off state;

initializing the plurality of machines by placing all indicator means to the off state;

reflecting individual communal play participation by placing the indicator means to the on state on each of the plurality of gaming machines having received a communal contribution;

displaying the effect of communal play, and distributing a series of awards to communal players when at least one player in the community of players achieves a recognized winning outcome by giving an award to the one player achieving the winning outcome and another award to remaining players.

11. The method of claim 10 wherein distributing a series of awards to communal players includes the steps of distributing a primary amount of a communal jackpot to at least the one winning player and a remainder of the communal jackpot to all remaining communal players.

12. The method of claim 10 wherein displaying the effect of communal play includes the step of displaying a dynamic communal jackpot amount.

13. The method of claim 10 further including the step of distributing a first award to at least the one player in the community of players who achieved the recognized winning outcome.

14. A method for providing a cooperative group gaming system; the steps including:

providing a bank of gaming machines, each said gaming machine including an indicator identifying each said gaming machine and having means for individual play and communal play;

initializing the system by turning off all indicators identifying the gaming machine;

selecting at least one bonus combination which constitutes a bonus event;

turning on the indicator of each gaming machine having received a communal wager for identifying each player participating in the communal jackpot;

providing at least one display means operatively coupled to the bank of gaming machines for displaying a communal jackpot and at least the one bonus combination;

distributing a plurality of awards to communal players when at least one player in the community achieves a recognized winning outcome by giving an award to the one player achieving the winning outcome and another award to remaining players.

15. The method of claim 14 further including the step of receiving wagers from a plurality of players playing the gaming machines.

16. The method of claim 15 further including the step of computing the amount of the wagers which will be provided to a communal jackpot.

17. The method of claim 16 further including the step of displaying the communal jackpot amount on the display means.

18. The method of claim 17 further including the step of providing an indicator means of each player participating in the communal jackpot.

19. The method of claim 17 further including the step of providing game play on each game having received a wager by a player.

20. The method of claim 19 further including the step of counting the number of players participating in the communal jackpot.

21. The method of claim 20 further including the step of awarding a primary award to at least the one player who has achieved a winning outcome.

22. The method of claim 21 further including the step of awarding residual awards to the remaining players participating in the communal jackpot.

23. The method of claim 22 wherein the step of awarding the residual awards includes the step of computing the residual award for each player by utilizing the formula:

$$RA=(JP-PA)/NP$$

Where RA is the residual award for each player,

JP is the total communal jackpot amount

PA is the amount of the primary award, and

NP is the number of players in addition to the primary award winner.

24. The method of claim 23 including the step of computing the primary award amount as a percentage of the total communal jackpot amount.

25. The method of claim 24 further including the step of resetting the communal jackpot and bonus combination for subsequent play.

* * * * *

UNITED STATES PATENT AND TRADEMARK OFFICE

CERTIFICATE OF CORRECTION

PATENT NO. : 6,077,162

DATED : June 20, 2000

INVENTOR(S) : Weiss, S.

It is certified that error appears in the above-indentified patent and that said Letters Patent is hereby corrected as shown below:

On the cover page of the patent where the assignee data is listed, kindly change "Sacramento Calif." to --Las Vegas, Nevada--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*